United States Patent [19]

Vogtländer et al.

[11] Patent Number: 4,636,192

[45] Date of Patent: Jan. 13, 1987

[54] APPARATUS FOR FOLDING A FOLDABLE SHEET

[75] Inventors: Alfred Vogtländer; Elsbeth Vogtländer, both of Waldbröl-Hermesdorf, Fed. Rep. of Germany

[73] Assignee: Falk-Verlag fur Landkarten und Stadtplane Gerhard Falk GmbH, Fed. Rep. of Germany

[21] Appl. No.: 771,694

[22] Filed: Sep. 3, 1985

[30] Foreign Application Priority Data

Sep. 21, 1984 [DE] Fed. Rep. of Germany ..... 3434630

[51] Int. Cl.[4] ..... B31F 1/00; B31F 7/00

[52] U.S. Cl. ..... 493/451; 493/405; 493/416

[58] Field of Search ..... 270/16, 40; 493/405, 493/413, 416, 417, 451, 454, 455, 456

[56] References Cited

U.S. PATENT DOCUMENTS 3,700,230 10/1972 Cook ..... 493/456

3,753,558 8/1973 Sheroff et al. ..... 493/405 X 4,502,711 3/1985 Muth ..... 493/405 X 4,571,237 2/1986 Vogtlander ..... 493/416

*Primary Examiner*—E. Michael Combs

*Attorney, Agent, or Firm*—Body, Vickers & Daniels

[57] ABSTRACT

A process and a device for folding a foldable sheet, in particular a map sheet, made of stiff paper or plastic, which is star-folded, in which the outward folds (13,14) and inward folds (12) that meet at the center point (M) of the sheet (10) are formed simultaneously by V-shaped carriers (33*a* and 33*b*) and first folder elements (37*a*,37*b*) that can be swung upwards perpendicular to these and in which, when the halves (10*a*,10*b*) of the sheet (10) that are defined by the outward folds (13,14) are folded together the corner inward folds (23,24) are made by second folder elements (71*a*,71*b*) that are articulated onto the side edges (72) of the carriers (33*a*,33*b*) and swing down on these, whereupon the two folded halves (10*a*,10*b*) of the sheet (10) are pressed together between the carriers (33*a* and 33*b*), the clamping plates (45), the second folder elements (37*a*,37*b*) before the folded sheet that has been folded together is grasped by the gripper (40) and withdrawn between these plates after the designated plates have been depressurized.

10 Claims, 16 Drawing Figures

APPARATUS FOR FOLDING A FOLDABLE SHEET

Figure 1:
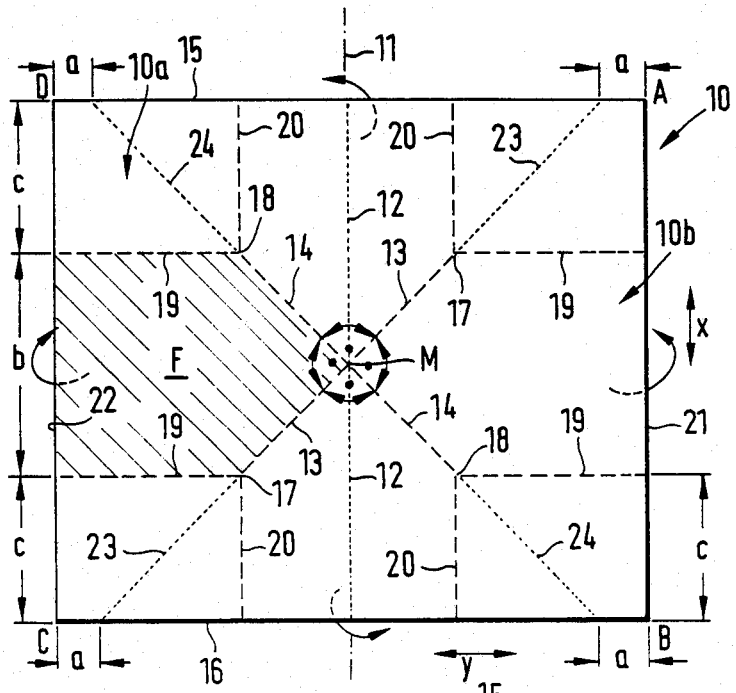

The present device relates to a process and a device for folding a foldable sheet, in particular a map sheet, in which rectilinear folds extend from the approximate centre point of a surface of the sheet, these forming an inward fold and an outward fold in alternation, the outward fold and the inward fold in each instance being paired opposite each other, the outward folds—that extend approximately to the corners of the sheet—split at a distance from the corner to form edge outward folds that are approximately parallel to the edges of the sheet that come together at the corners, with, in each instance, a corner inward fold that goes to the corner extending from the point of division.

Sheets that are of stiff paper or some such suitable material and have been provided with such folds can be folded together in the manner of a book when, because of the formation of inward folds, a large sheet can be folded into approximately one-fifth of its original size, and the folding can be effected by simply closing the sheet together about a transverse axis. Folding sheets of this kind are particularly suited for small topographic maps or plans, for promotional materials, menus, and the like, and make it possible to open out a folded map completely with a single folding motion and then refold it into a very small format by simply closing it up.

A folding sheet of the kind described in the introduction hereto is already known from DE-PS 856 964; in this, outward folds and inward folds that are aligned with each other are folded onto each other in sequence (around the sheet), the corner inward folds subsequently being made by hand. This method of producing such sheets is inconvenient and costly, since all the folding procedures have to be executed manually. Furthermore, production takes up a great deal of time, even though several sheets are folded simultaneously.

It is the task of the present invention to describe a process and a device, by means of which sheets can be provided with all the required folds very simply by machine, and brought to the required book form.

This task has been solved with the process according to the present invention in that outward folds and inward folds are formed simultaneously, these coming together at the centre point of the surface of the sheet, and in that when the halves of the sheet that are defined by the outward folds are folded together, the corner inward folds are formed, so that when the halves of the sheet are subsequently pressed together, the edge outward folds are also formed.

Such a process makes it possible to fold sheets—that can be reduced in size by being folded together—very rapidly even if said sheets are folded one after the other, since several folds are formed simultaneously and the edge outward folds are formed automatically when the sheet is pressed together.

In this regard it is particularly expedient if the corner inward folds that are diagonally opposite each other are made simultaneously or adjacent corner inward folds of each half of the sheet are made after one another. On making the inner corner folds the tools used for this purpose cannot collide and the sheet is stressed equally, with the result that it does not become distorted and even and regular folds are made in it.

It is particularly expedient if—when the outward folds and the inward folds that meet at the centre point—the sheet is first folded in a V-shape along an axis of fold that extends transversely to its longitudinal direction to the point that the halves of the sheet for an angle of approximately 60° to each other, the corner inward folds being made after this is done, and finally the halves of the sheet are pressed together. During such a process such folding tools as pivot about shafts that coincide with the edge outward folds can be used to advantage, for this results in a particularly simple construction of the device.

In order to simplify the folding process, it is expedient to perforate the sheet in the vicinity of all the folds. As opposed to scoring, such a process entails the advantage that all of the folds can be processed from the same side of the sheet, whereas scoring has to be done from one side of the sheet or the other, depending on whether it lies in the fold line of an inward or an outward fold, in order that it is opposite the rear of the fold in each instance.

Depending on the shape of the sheet, the inward folds and the outward folds can be arranged in the sheet in different ways, as is described in details, for example, in DE-PS 856 964 cited above. However, for the completion of the process according to the present invention, it is particularly advantageous that the outward folds intersect at right-angles and the axes of fold run perpendicular to the longitudinal axis of the sheet.

Essentially, the device that is used to complete the process according to the present invention is characterized by two flat carrier elements for the sheet that is to be folded; these can be folded onto each other about a shaft that lies in their plane and has the two first folding elements that can be pivotted about the centre point of the sheet that is arranged between the flat carriers, in a plane that passes through the axis of the fold, said plane halving the angle between the flat carriers; each of the second folders is provided with a fold edge that extends through the point of division of an edge outward and is pivottable about this point of division such that it describes a partially conical surface outline (generatrix); clamps are provided to secure the sheet on the carrier. Using a device of this type it is possible to provide one sheet after the other with the required folds by machine; this proceeds extremely rapidly since several folds can be made simultaneously without the tools that are required for this operation colliding with each other.

It is expedient that the clamps have flat clamping surfaces and an outer outline that corresponds approximately to the outer outline of the folded sheet, or is preferably a little smaller. The clamping surfaces then hold the sheet securely in the area of its outer edges, which limit it to the outside when it is in the folded state. This permits easy and precise folding of the map on the edges of the clamping surfaces.

The clamps can be brought from the edge of the carriers that is opposite the folding axis out into a clamping device with the carriers. This entails the advantage that the carriers are completely free when the sheet that is to be folded is laid in position, and that the carriers are stopped in a location and moved where they do not hinder the folding process.

It is advantageous that the clamps are clamping plates that can be swung down onto the carriers about shafts that are are arranged next to the edges of the carriers that are opposite the folding axis. This makes it possible to clamp the sheet that has been positioned on the carriers simply and easily, and the edges of the clamping plates form fold straightedges with which the edge outward folds are formed when the corner inward folds are made.

It is expedient that the carriers have an outline that corresponds to the outline of the folded sheet and parallel side edges that correspond to the edge outward folds of the sheet, on which the second folding elements are articulated. This entails the advantage that after being folded the sheet can be folded together when laying on the carriers and when the carriers are folded can be withdrawn between these.

The second folding elements are essentially triangular folder plates that are arranged so as to be able to pivot on the side edges of the carriers, and their fold edges, which extend at an angle of approximately 45° to these side edges, form inner folds that extend almost to the corners of the sheet. A construction of this type is particularly simple and permits precise production of the corner inward folds during the simultaneous production of the edge outward folds, since the surface of the triangular fold plates is essentially matched to the surfaces that are made towards the interior and by an inward fold and the edge outward folds.

In order that the finally folded sheet that has been folded together can be removed from the folding machine when folded and then passed on for further processing, it is expedient that the carriers be carrier plates that are secured at their edges that are opposite the folding axis to pivotting devices that can pivot about the folding axis, and at their edges that face towards the folding axis have openings, of which the recesses of the one carrier plate cover off the recesses of the other carrier plate when said carrier plates are folded together and that a gripper having gripping elements is provided, said gripping elements engaging in the recesses to grasp the folded sheet and, when the carrier plates are closed, withdrawing the sheet between these. In the version according to the present invention this is easily done, since the pivotting devices for the carrier plates pivot about pivot trunnions, these trunnions being located beyond the range of movement of the carriers and the folding elements, and for this reason the space beneath the carriers in the area of the folding axis is free.

The face edges of the carriers that face the folding axis run best at an angle of 45° to the folding axis and line up with the fold edges of the second fold elements when these are in one plane, extended with the associated carriers to which they are hinged. This entails the advantage that, when folded together, the carriers and the folders take up no greater area than the sheet that is folded and then folded together, so that this can be easily grasped by the gripper and then withdrawn between the carrier plates that are the lying one above the other without exerting any pressure on each other.

In order that the arms of the grippers can be introduced easily into the recess in the carriers that are provided for this purpose, the first folder elements are formed from two folder plates, to which first pivotting means for pivotting in between the carriers and second pivotting means for pivotting out partially from between the carriers are secured, in order to free the recesses in the carriers once these have been pressed together. The plate-like shape of the folder elements makes it possible to leave these between the folds in the sheet after pivotting inwards and forming the transverse inward folds, so that the sheet can be pressed together with the folder plates still in place. Since these folder plates are only partially pivotted out by the second pivotting means, they stabilize the sheet when it is withdrawn, still folded, by the gripper.

Various power units can be provided to drive to individual folding and pivotting elements as well as the carriers. However, it is especially expedient to provide pneumatic power for all the moving parts, for this permits reliable high-speed operation and can then be depressurized once the folds have been produced and the sheet folded together, so that the sheet that has been folded together can be withdrawn easily from between the various carrier plates, clamping plates and folding plates and then move on to further processing stages.

Additional features and advantages of the invention are set out in the following description and in the drawings, in which the sequence of the process according to the present invention and the construction of a preferred version of the device according to the invention are shown and described on the basis of an example.

Figure 2:
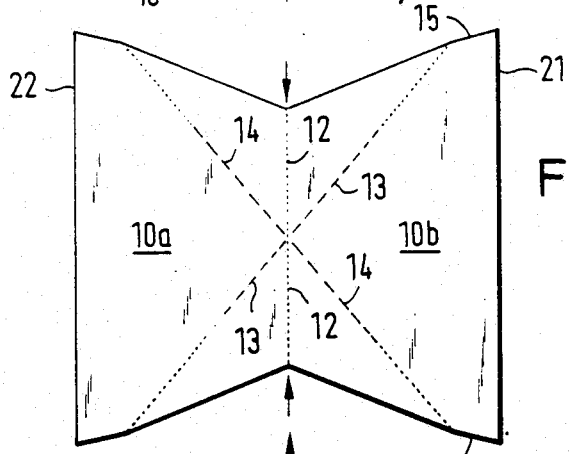
Figure 3:
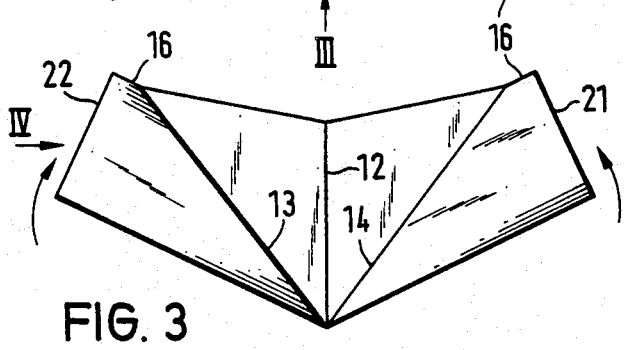
Figure 4:
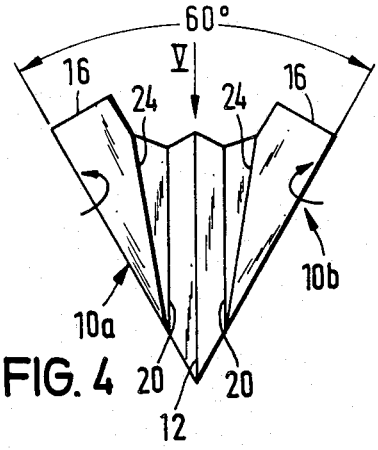
Figure 5:
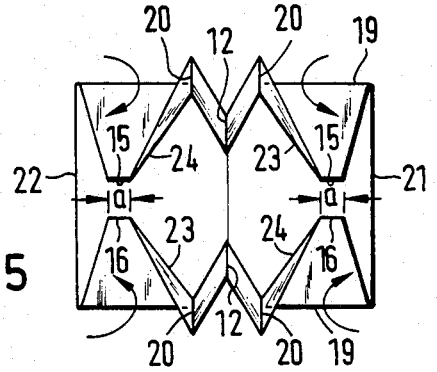
Figure 6:
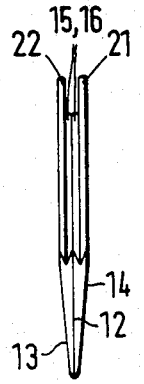
Figure 7:
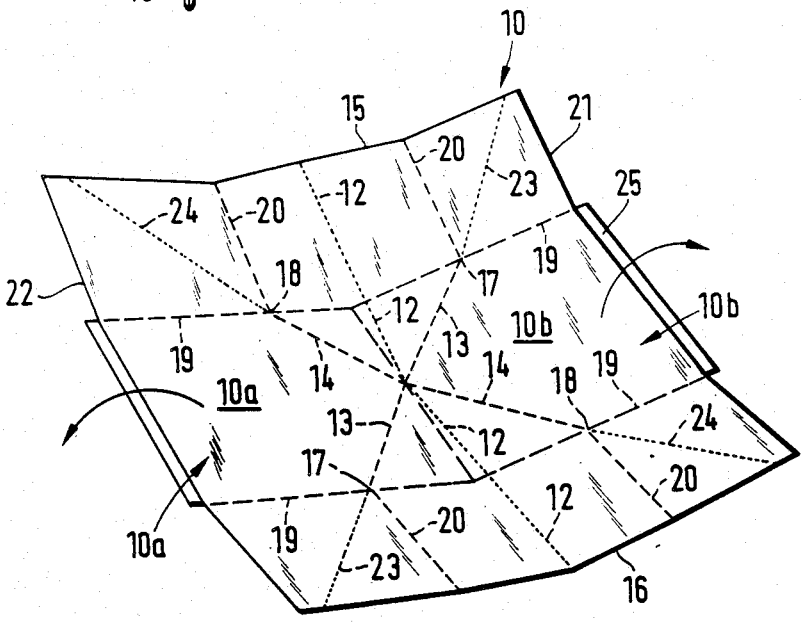
Figure 8:
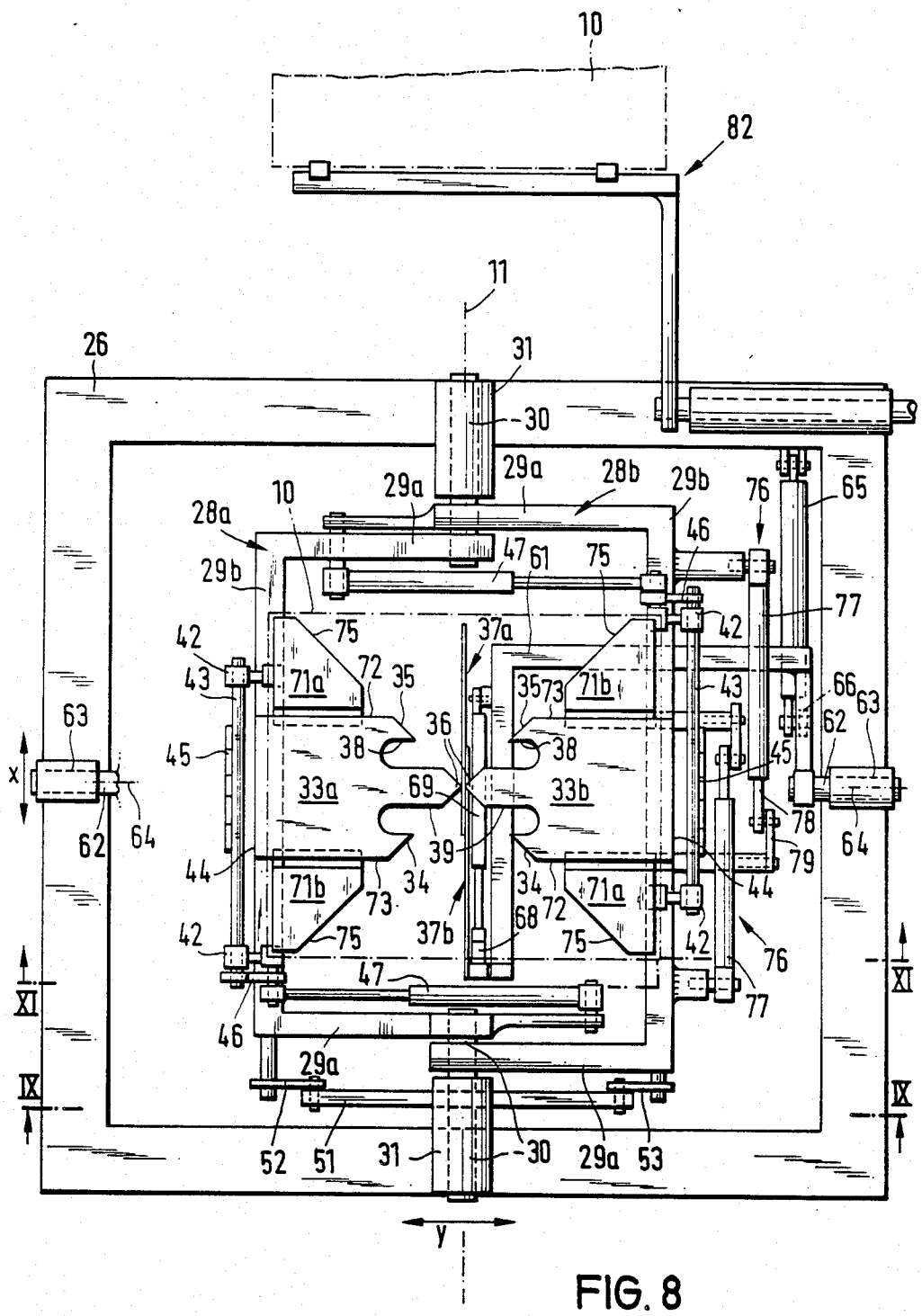
Figure 9:
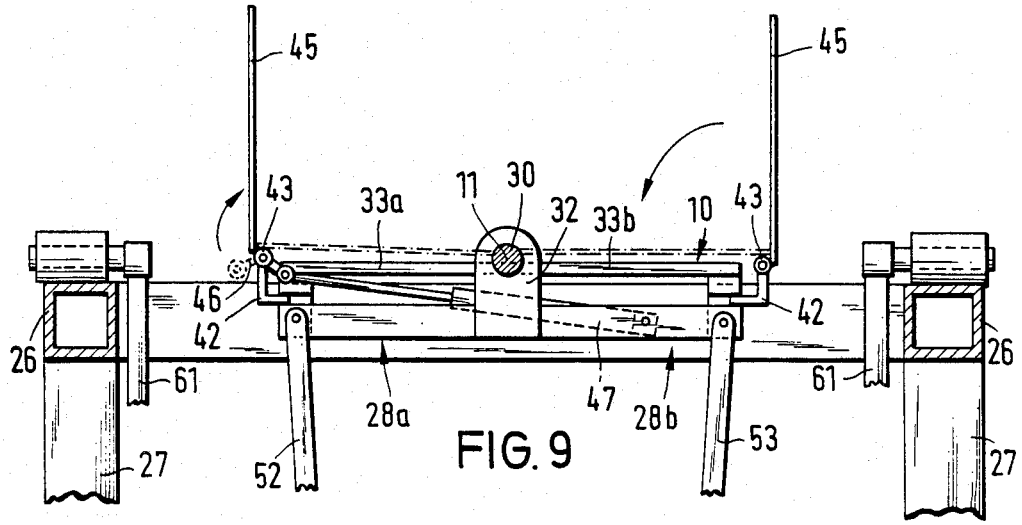
Figure 10:
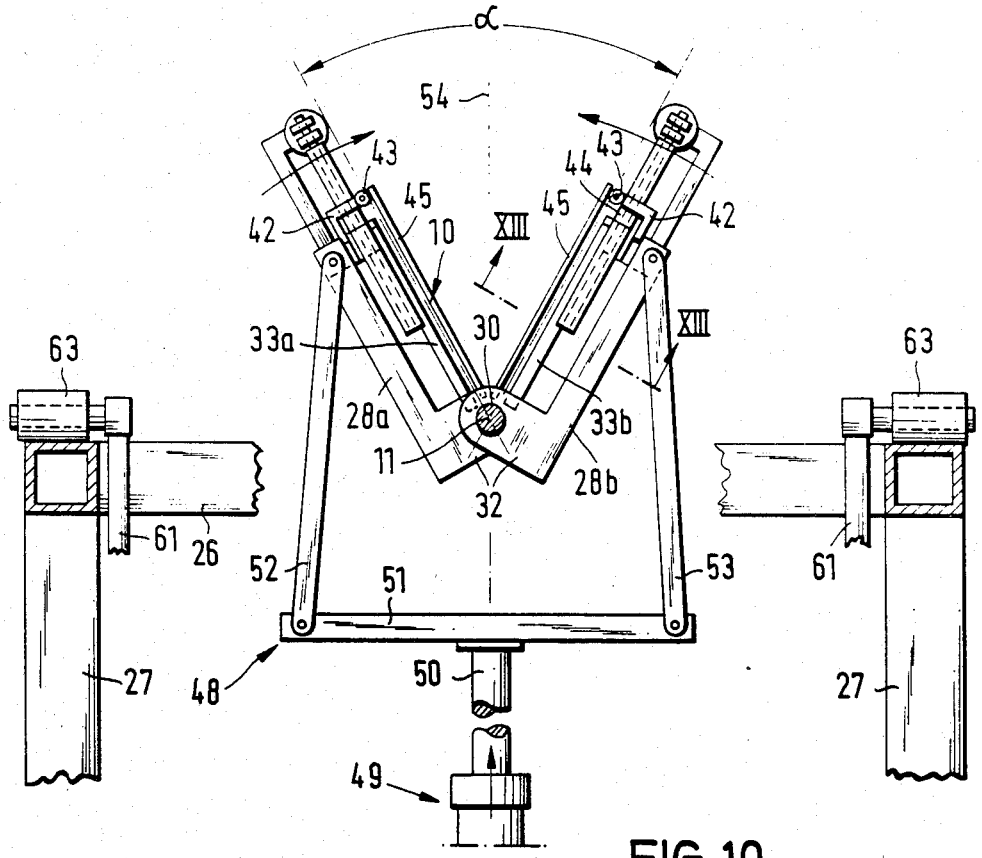

These drawings are as follows:

FIG. 1: A sheet that is to be folded according to the present invention, this being perforated on the lines of the folds;

FIG. 2: A plan view of the sheet that is to be folded, at the start of the folding process;

FIG. 3: A front view of the object of FIG. 2, seen in the direction of the arrow III;

FIG. 4: the Sheet as in FIG. 3, viewed from the front in the direction of the arrow IV, during a further stage in the process, as the inner corner folds are being made;

FIG. 5: A plan view of the object in FIG. 4;

FIG. 6: The folded sheet, folded together, the halves of the sheet lying one atop the other, viewed from the front;

FIG. 7: The folded sheet, produced according to the process according to the present invention, this being glued into a cover, shown when opened up;

FIG. 8: A device for folding a sheet according to the invention, this being in plan view, some parts having been omitted for the sake of clarity;

FIG. 9: The object of FIG. 8 in a partial vertical section on the line IX—IX in FIG. 8, in the first working position;

FIG. 10: A representation of the folding device that corresponds to FIG. 9 in a second working position.

Figure 11:
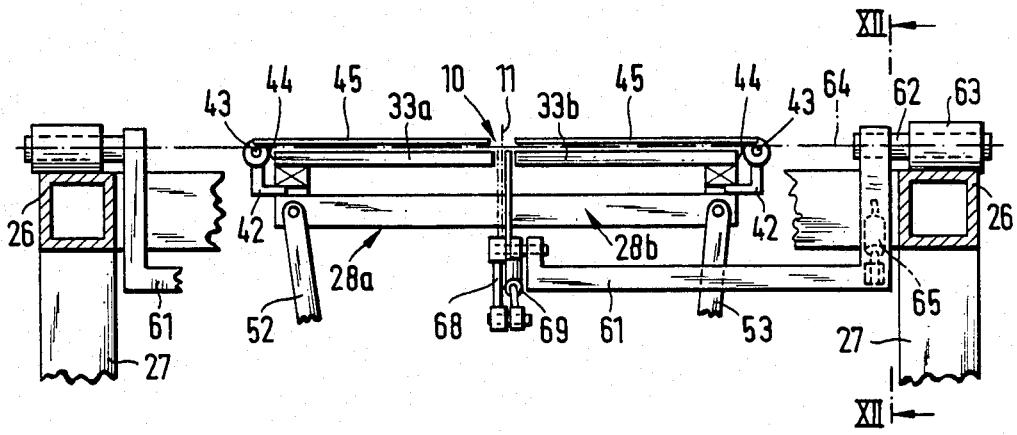
Figure 12:
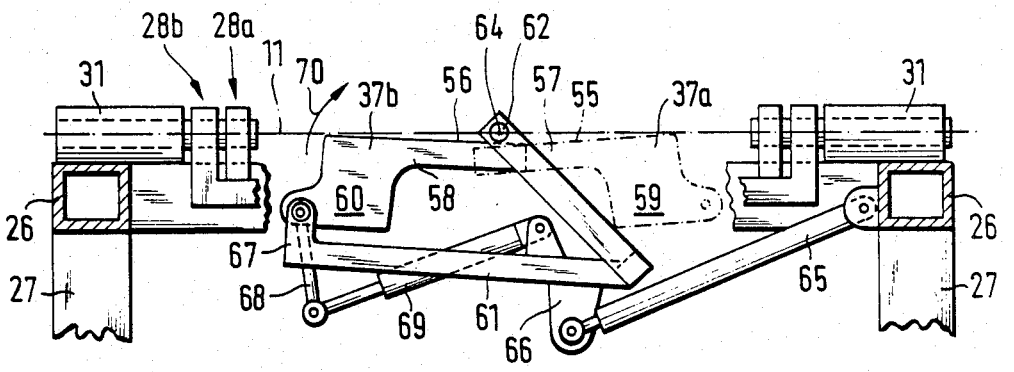
Figure 13:
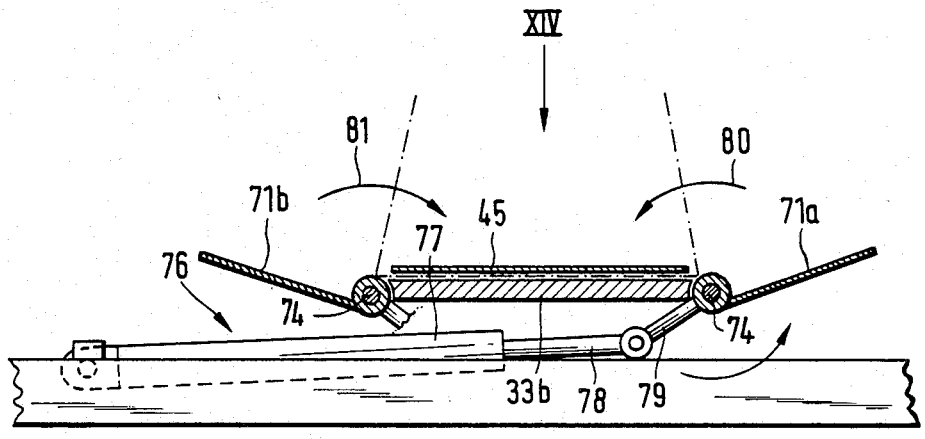
Figure 14:
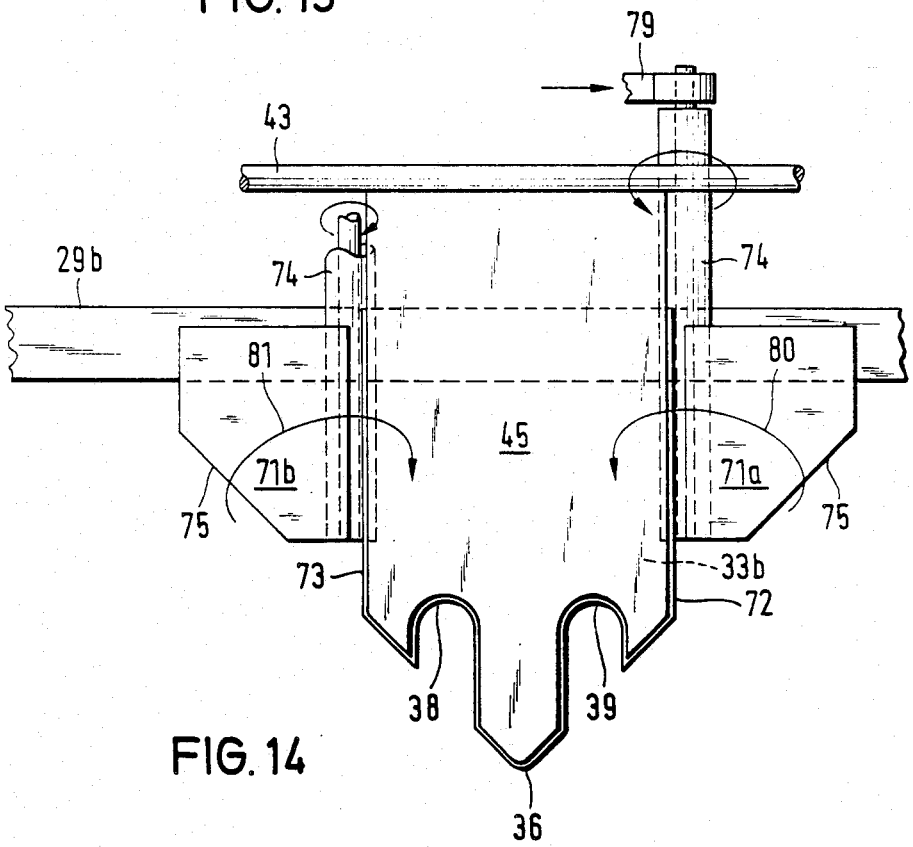
Figure 15:
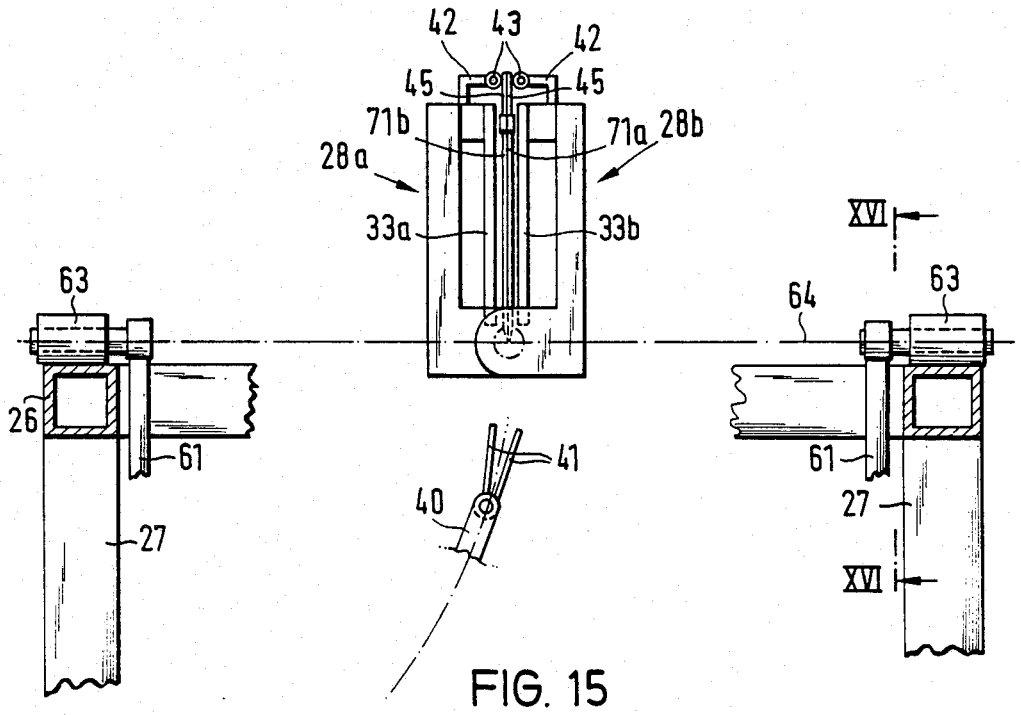
Figure 16:
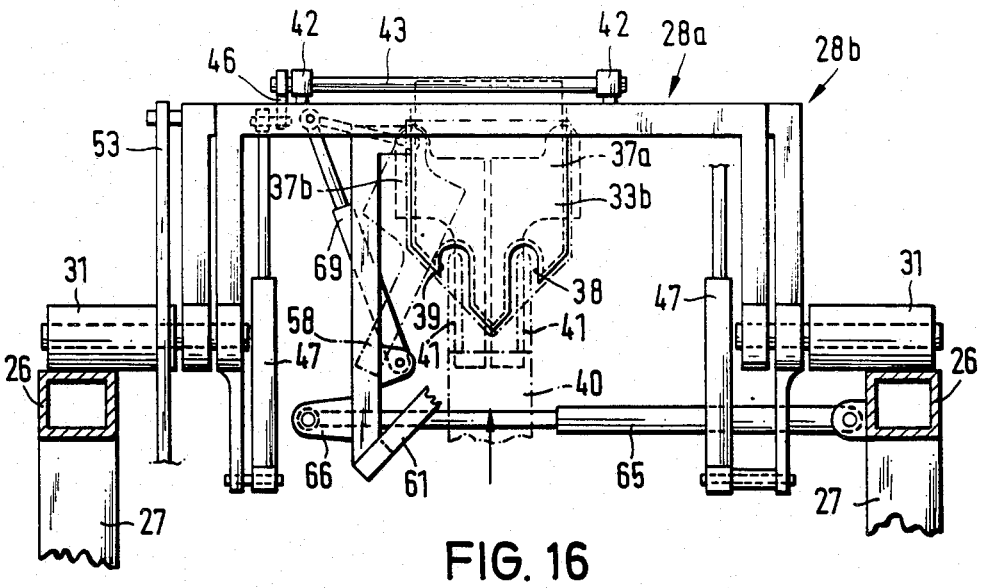

FIG. 11: The folding device as in FIG. 8, in a vertical longitudinal section on the line XI—XI in FIG. 8, in which the first folder element with its drive can be seen;

FIG. 12: The object of FIG. 11 in a cross-section on the line XII—XII, in which only the first folder element with the drives of only one of the two folder elements is shown, the remaining parts being omitted;

FIG. 13: A partial cross-section of FIG. 10 on the line XIII—XIII at enlarged scale;

FIG. 14: The object of FIG. 13 in plan view, viewed in the directon of the arrow XIV—XIV;

FIG. 15: The folding device according to the invention, in a longitudinal section analogous to FIG. 10, in a third working position, in which essentially only the carriers with the clamping plates and the sheet, enclosed between these and folded together, are shown;

FIG. 16: The object of FIG. 15 in a vertical cross-section on the line XVI—XVI, the gripper being pivotted inwards and with first folder elements folded partially outwards, only one of these being shown.

FIGS. 1 to 7 show a sheet 10 of stiff paper or some other suitable material, which is to be folded to the shape of the area F and to this end provided with outward folds and inward folds arranged as is shown in FIG. 1, thus making it possible to fold it like a book about a centre axis or folding axis 11 that runs transversely to its longitudinal direction. The term "outward folds" is to be taken as defining edges that for formed in the sheet 10 and which, when the sheet is pressed together, are formed along a line and are oriented outwards, which is to say that when the sheet is folded they lie behind the original plane of the sheet. The term "inward folds" is taken as defining sheet edges that are oriented inwards when the sheet is folded, which is to say they project inwards above the plane of the sheet. In the drawing, outward folds are indicated by dashed lines, inward folds by dotted lines, whereas continuous lines indicate the outline of the sheet.

It can be seen from FIG. 1 that the sheet 10 is of a rectangular overall area, the longitudinal direction being lettered X and the transverse direction being lettered Y. The fold lines on which the inward and the outward folds are to be formed, and along which the sheet is folded together when the two halves of the sheet 10*a* and 10*b* are folded together along the folding axis 11 in the manner of a book, are perforated in the form of a line of closely packed perforations or cuts.

It can be seen from FIG. 1 that the sheet 10 has at its centre inward folds 12 that extend in the direction of the X axis; these are lined up with each other and in the course of the folding process to be explained later they lie opposite each other as a pair. At the centre point M of the sheet 10 four outward folds 13 and 14 intersect with the inward folds 12; these, too, lie opposite each other as a pair and form a right-angle with each other. This is expedient from the point of view of the invention but not essential for the completion of the process according to the present invention. As an example, the outward folds 13 and 14 could be arrange at an angle that is smaller than 90°.

The outward folds 13 and 14 are directed approximately to the corners A, B, C, and D of the sheet and intersect its long edges 15 and 16 at a distance a from the corners.

The area F, into which the sheet 10 is to be folded together, is of a width b in the x-direction and is defined by the outward folds 13 and 14 and by the edge outward folds 19; these are parallel to and at a distance c from the long edges 15 and 16 and intersect the fold lines of the outward folds 13 and 14 at the points of division 17 and 18. Other edge outward folds 20 that are parallel to the transverse edges 21 and 22 of the sheet 10 extend from these points of division 17 and 18.

From the points of division 17 and 18 the folds that extend from the centre point M approximately to the corners A, B, C, and D are inward folds and these subsequently designated "corner inward folds" 23 and 24.

After the sheet 10 has been perforated along the fold lines indicated in FIG. 1, the two halves 10*a* and 10*b* of the sheet are folded up about the folding axis 11 into a V-shape. Simultaneously, the sheet is pressed inwards along the inward fold 12, whereupon the outward folds 13 and 14 start to form. The shape that results from this is shown in plan view in FIG. 2 and from the front in FIG. 3. At the beginning of the folding process the folds 23 and 24 are still in the form of outward folds.

When the two halves 10*a* and 10*b* of the sheet, i.e., essentially, their areas F defined by the outward folds 13 and 14 and the edge outward folds 19, form an angle of some 60°, with the inward folds 12 forming an angle of approximately 45° at the centre point M of the sheet, the corner inward folds 23 and 24 are formed inwards from the outside, and simultaneously the edge outward folds 19 and 20 begin to form. When this happens, either diagonally opposite corner inward folds or adjacent corner inward folds 23 and 24 are made simultaneously from different halves 10*a* and 10*b* of the sheet. Adjacent corner inward folds 23 and 24, that are in the same halves 10*a* and 10*b* of the sheet should not, however, be made simultaneously, but in sequence, in order that the folds that are formed during the process do not hinder each other. The production of the corner inward folds is shown in FIGS. 4 and 5.

As soon as the corner inward folds 23 and 24 have been made simultaneously in pairs, the two halves 10*a* and 10*b* of the sheet are pressed firmly together, when they fold about the folding axis 11 and the sheet 10 assumes its fully folded position, as is shown in FIG. 6. All the folds are now fully formed and the sheet 10 has been folded up to the point that it only as large as the area F, which amounts to only approximately one-fifth of the original area of the sheet 10 when it is spread out.

The sheet 10 can then be cemented by the outer surface of the area F into a stiff binding, as is indicated in FIG. 7 at 25. When this is then opened, the sheet 10 will unfold automatically, whereupon the ouward folds 13, 14, the inward folds 12, the outward edge folds 19, 20 and the corner inward folds 24 remain slightly set. When the cover 25 is folded together and the halves 10*a* and 10*b* of the sheet that are cemented to this the sheet 10 will then fold on its own on the folds that have been formed, and will once again assume the position that is shown in FIG. 6.

A device according to the present invention, with which the sheets can be folded and then folded up by the process according to the present invention, is shown schematically in FIGS. 8 to 16. In order to make the interaction of the various parts clear, only one of those parts of the device that are used in pairs has been shown, insofar as this is sufficient for a clear understanding of the invention. In addition, only those components or constructional units that are being described are shown in the various sectional planes that are illustrated, other parts being omitted even, since they are not essential to a clear understanding of the invention, even though they are found in the same sectional plane.

The device shown in the drawings, used to fold a sheet, has a main frame 26 that is approximately horizontal and virtually quadrilateral. This main frame can be part of a larger installation, and can be supported by columns 27 on the ground or in a special ground frame. In the middle of the opening enclosed by the main frame 26 there are two pivotting devices 28*a*, 28*b* that are configured as a U-shaped tilting frame which is supported by its free arms 29 on shaft trunnions 30 so as to be able to pivot, these trunnions 30 being secured to the main frame 26 by the sleeves 31. The trunnions 30 extend in the direction of the X-axis, arranged in the centre of the main frame 26, their axis coinciding with the folding axis 11.

The U-shaped pivotting frames 28*a* and 28*b* have bearing supports 32 that project upwards on their arms 29, with which they are supported on the trunnions 30 in such a way that the planes of the U-shaped tilting frames 28*a* and 28*b* formed by the arms 29*a* and the cross member 29*b* are at a specific distance from the folding axis 11 (FIGS. 9 and 10).

A carrier 33 in the form of a rectangular carrier plate 33*a* or 33*b* is secured to the upper side of the cross member 29*b* of each tilting frame 28*a* or 28*b*, the face edges of these plates 33*a* or 33*b* that face towards the folding axis 11 being tapered at approximately 45° so as to form a point 36. The points 36 of the two carrier plates 33*a* and 33*b* are opposite to each other and separated by a narrow gap that is left open and in which the first folder elements 37*a* and 37*b* are arranged; this is explained in greater detail below.

As can be seen in particular from FIGS. 9 to 11, the carrier plates 33*a* and 33*b* as so secured to the tilting frames 28*a* and 28*b* that their surfaces lie in one plane with the folding axis 11, so that a sheet 10 that is laid on the carrier plates 33*a* and 33*b* can be folded when the carrier plates are swung upwards about the folding axis 11.

As can be seen especially clearly from FIGS. 8 to 14, each carrier plate 33*a* and 33*b* has, on its edges 34 and 35 that face the folding axis 11 two open-edge recesses 38 and 39, which can accomodate a gripper 40 with gripper elements 41 (FIGS. 15 and 16), as is described in greater detail below.

The cross member 29*b* of each tilting frame 28*a* or 28*b* carries—on angle pieces 42—a pivot shaft 43 that is arranged next to the edge 44 that is opposite the folding axis 11, and this pivot shaft extends parallel to this edge. On each pivot shaft 43 there is secured, for example by welding, a flat, relatively thin clamping plate 45 with one edge freely extending, the outline of this clamping plate corresponding approximately to the outline of the sheet that is folded together, and which is somewhat smaller than the area F that is shown in FIG. 1. Each clamping plate 45 can be pivotted down with its pivot shaft 43 by a rocker arm 46 operated by a pneumatic cylinder 47, onto its associated carrier plate 33*a* or 33*b* so as to clamp this sheet that is to be folded onto this particular carrier plate. When pivotted down in this manner, the surface of each clamping plate 45 that is turned to face the sheet 10 is in a plane that passes through the folding axis 11 (FIG. 10).

In order to fold the sheet that has been laid on the carrier plates 33*a* and 33*b* and secured by the clamping plates 45 in the middle and move it into the V-position described above, the two tilting frames 28*a* and 28*b* can be pivotted upwards with a first pivotting device 28, whereupon the arms 29*a* of the tilting frames 28*a* and 28*b* turn on the trunnions 30 until the carrier frames are in the V-position relative to each other that is shown in FIG. 10, and in which the surface planes of the carrier plates 33*a* and 33*b* subtend an angle of approximately 60° with each other and their points are at such a distance from each other that there is a small gap left between them. As can be seen in particular from FIG. 4, the first pivotting device 48 consists of a pneumatic cylinder 49 that is suitably arranged in the machine frame, the piston rod 50 of which bears a yoke 51 that extends in the direction of the Y-axis, at the free end of which there is a bell-crank lever 52, a bell-crank lever 53 being secured to its other end so as to be able to move. The bell-crank lever 52 is articulated by its other end to the tilting frame 28*a*, whereas the lever 53 is secured to the tilting frame 28*b* so as to be able to move. It can be seen that when the cylinder 50 is extended the bell-cranks 52 and 53 tilt the tilting frames 28*a* and 28*b* upwards into the position that is shown in FIG. 10, whereas when the piston 50 is retracted they return the tilting frames 28*a* and 28*b* to their original and horizontal starting positions.

As has already been stated, first folder elements 37*a* and 37*b* are arranged in the gap between the points 36 of the carrier plates 33*a* and 33*b*. These first folder elements are formed from two folder plates that are in a plane 54 that passes through the folding axis 11, said plane halving the angle X subtended between the flat carriers 33*a* and 33*b* (FIGS. 8 and 10). In the arrangement that is shown in the figure, the first folder elements 37*a* and 37*b* are thus in a vertical plane between the points 36 of the carrier plates 33*a* and 33*b*.

As can be seen from FIGS. 12 and 16, the folding plates 37*a* and 37*b* are of angular shape and are arranged in such a manner that when in their starting positions, the upper folding edges 55 and 56 of their free ends 57 and 58 are in a more or less horizontal position directly beneath the sheet 10 that has been laid on the carrier plates 33*a* and 33*b*. The other arms 59 and 60 of each folder element 37*a* or 37*b* is supported on the main frame 26 so as to be able to pivot, by means of a cranked idler arm 61; only one of the two idler arms is shown in FIGS. 8, 11, 12, and 16, and this serves to drive the folder element 37*b*. It can be seen from FIG. 8 that the idler arms 61 with the trunnions 62 are supported in bearings 63 that are located at the centre of the cross members of the main frame 26, so that the idler arms 61 can pivot about a cross shaft 64 that extends in the direction of the X-axis and is in the same plane as this. A first pivotting means 65 in the form of a pneumatic and oscillating cylinder is secured on each idler arm 61; this cylinder is secured to the main frame 26 such that it can pivot and its piston rod is articulated to a tab 66 that is attached to the idler arm 61. One of the first folder elements 37*a* or 37*b* is mounted so as to be able to pivot on the outer, free end 67 of the idler arm 61, and this element is attached rigidly to a lever 68 that is connected to a second pivotting device 69 in the form of a pneumatic cylinder and this in its turn is connected to the idler arm 61 so as to oscillate (FIG. 12). When the second pivotting device 69 assumes the position shown in FIG. 12, when the piston rod of the first pivotting device 65 is extended the folder element 37*b* can swing upwards from the position that is shown in FIG. 12, in which its fold edge 56 is in a more or less horizontal position, about the cross shaft 63 in the direction of the arrow 70, until its fold edge 56 first assumes an angle of 45° to the horizontal, which corresponds to the position of the carrier plates as in FIG. 1, and then reaches a position in which the fold edge 56 is vertical. In the same way, the first folder element 37 can be swung counter-clockwise by its first pivotting device from the position indicated by the dashed line in FIG. 12, until its fold edge 55 first assumes an angle of 45° and later an angle of 90° to the horizontal.

The above-mentioned second pivotting devices 69 move the first folder elements sideways once the sheet has been folded and then folded together, this being done to expose the recesses 38, 39 in the carrier plates 33*a*, 33*b*, and the clamping plates 45 and to permit the insertion of the gripper elements 41 of the gripper 40, as is described in greater detail below.

Second folder elements 71 are provided to make the corner inward folds; these elements consist essentially of triangular folder plates 71*a* and 71*b* that are secured in pairs, in such a manner as to be able to pivot, on the two side edges 72 and 73 of each carrier plate 33*a*, 33*b* by the use of hinges (FIGS. 8, 13, 14). Each folder plate 71*a* or 71*b* is in the shape of a right-angled triangle, the corners of which have been cut off parallel to the opposite short sides, and the hypotenuse of which forms a fold edge 75 which, in the starting position that is shown in FIG. 8, wherein the folder plates together with the carrier plates are in a horizontal plane, lines up with the edges 34 or 35 of the carrier plates 33*a* or 33*b* and thus, like these, extend at approximately 45° to the side edges 72, 73 or the carrier plates. Each folding plate 71*a* or 71*b* can be pivotted by a pivotting device 76 about the side edge 72 or 73 of that carrier plate 33*a* or 33*b* to which it is articulated by means of the hinges. However, in FIG. 8 only the pivotting devices for the folding plates 71*a* and 71*b* of the righ-hand carrier plate 33*b* are shown even though, of course, the folding plates for the left-hand carrier plate 33*a* have identical pivotting devices.

Each pivotting device consists of a pneumatic cylinder 77, this being attached to the associated tilting frame 28*a* or 28*b* so as to be able to oscillate, and whose piston 78 is articulated onto an operating lever 79, this being connected rigidly to the folding plate 71*a* or 71*b*. When the piston 78 is extended the folding plates 71*a* or 71*b* are swung down on to the clamping plate one after the other in the direction of the arrows 80 and 81, whereupon their fold edges 75 follow a path that describes the outline of a truncated cone, the tip of which is in approximately the same place at which a side edge 72 or 73 respectively intersects with the adjacent edge 35 or 34 or the carrier plate.

It should be pointed out that the clamping plates 45, the first folder elements 37 and the second folder elements 71 are stiff but relatively thin plates, so that they form narrow fold edges and take up very little room, which is very important if they are to lie one atop the other between the individual folds that are made in the sheet.

The device that is shown in FIGS. 8–16 operates as follows:

First, a sheet 10 that is to be folded, which is more or less rectangular, is laid by the feed device 82, shown here only in outline, on the carriers 33, the first folder elements 37 and the second folder elements 71, of which the parts 33 and 71 are in the starting position shown in FIG. 8 in the same horizontal plane as the fold edges 55 and 56 of the first folder elements are arranged. The sheet 10, indicated by the dashed-dotted line, occupies the position shown in FIG. 8, in which it covers the carrier plates and the first and the second folder elements, the centre line of the sheet 10 coinciding with the folding axis 11 of the device. In addition, the different fold lines of the sheet, which can be seen from FIG. 1, are perforated as has been described above.

Once the sheet 10 has been positioned, the pneumatic cylinder 47 is activated; the clamping plates 45 (FIG. 9), which up to now have been vertical, swing downwards about their pivot shafts 43 onto the carrier plates 33*a* and 33*b* and clamp the centre portion of the sheet 10 (FIG. 11). Next, the pneumatic cylinders 49 and 65 are activated simultaneously, this causing the U-shaped tilting frames 28*a* and 28*b*, together with the carrier plates 33*a* and 33*b* that are attached to them and the sheet 10 that is clamped to them by the clamping plates, to swing upwards about the folding axis 11 until they reach the position shown in FIG. 10; simultaneously, the first folder plates 37*a* and 37*b* swing up into a position in which their fold edges 55 and 56 are at 45°, the apex being the the folding axis 11.

Once the carrier plates 33 and the first folder elements 37 have reached the intermediate position that has been described, the pivotting devices 76 are operated, whereupon the pistons 78 of the pneumatic cylinders 77 are extended and the second folder plates 71*a* and 71*b* pivot inwards about the side edges 72 and 73 of the carrier plates 33*a* and 33*b*. The fold edges 75 of this second folder plate 71*a* and 71*b* act on the sheet 10 when this takes place, working along the outer part of those fold lines that have been formed as outward folds in the area of the edges 34 and 35 of the carrier plates by the action of the first folder elements 37*a* and 37*b*, and fold the sheet inwards in this area until the folder plates together with the part of the sheet 10 that is between them lie closely against the carrier plates 33*a* or 33*b* (FIGS. 13 and 14).

It should be pointed out that when the folder plates 71*a* and 71*b* are swung inwards it is essential to adhere to a strict sequence in order that these second folder plates do not collide with each other when the sheet is closed up. Thus, for example, the folder plates 71*a* and 71*b* can be closed simultaneously on different sides of the folding axis. It is also possible to swing folder plates 71*a* and 71*b* that are diagonally opposite on both sides of the folding axis 11 down onto the carrier plates 33*a* and 33*b* and then let the next, second pair of folder plates swing down. In both cases the sheet will be folded without any collisions.

Once all the second folder plates 71*a* and 71*b* are lying closely on the associated clamping plates 45 the portions of the sheet that is to be folded are located between the carrier plate and the clamping plate the pneumatic cylinders 49 and 60 are operated once again in the same direction until the two pivotting frames 28*a* and 28*b*, the carrier plates 33*a* and 33*b*, and the clamping plates 45 that have been swung down onto these, and the second folder elements 71 all assume the vertical position that is shown in FIG. 15, and the first folder elements 37 are in the position shown in FIG. 16 by the dashed line, in which the fold edges 55 and 56 of these first folder plates 37*a* and 37*b* lie next to each other and the sheet 10 is folded together on the area F (FIG. 1).

When the device is in this position the cylinders 49, 47 and 77 are evacuated so that the sheet that is lying between the carrier plates 33, the clamping plates 45 and the second folder plates 71 is no longer pressed together by these plates, whereas the plates retain their essentially vertical position, however. In addition, the pneumatic cylinders 65 still hold the first folder elements 37*a* and 37*b* in their vertical position. In this position the second pivotting means 69 of the first folder elements 37 are activated, this causing the first folder plates 37*a* and 37*b* to pivot outwards about their points of articulation on the idler arms 61 until they take up the position indicated by the dashed-dotted line for the first folder plate 37*b*, in which the free arms 58 of the folder plates are located outside the recesses 38 or 39 of the carrier plates 33*a* and 33*b* and clamping plates 45. The pivot movement of the first folder plates 37*a*, 37*b* is possible since the carrier plates 33*a*, 33*b* and the clamping plate 45, as well as the second folding plates 71*a* and 71*b*, between which the first folding plates 37*a* and 37*b* are located, lie one on top of the other without exerting any pressure on each other, when the friction between these plates and the surfaces of the folded sheet is still great enough to prevent the sheet 10 that has been folded together, from falling.

Once the recesses 38 and 39 have been freed, a fork-shaped gripper 40 (FIG. 15) rises, the spread gripping elements 41 of which move into the the recesses 38 and 39 and slide over the folded sheet 10, and then grip this (FIG. 16).

When it swings back, the gripper 40 then takes the folded sheet 10, that is also folded together, and passes it to the next processing station, where a cover is fitted to it and it is then passed to a subsequent printing or collating stage.

The present invention is in no way restricted to the versions shown and described herein; various modifications and changes are possible within the framework of the basic and underlying concept of the invention. For example, electromagnetic or hydraulic power systems can be used for the pivotting means, and it is also possible to use frame-like carriers and clamping devices in place of the carriers and the clamping plates. In addition, fold rules, rods or the like could be used for the first and second folder elements in place of the folder plates, and these would then pivot in the same way as the fold edges of the folder plates. The clamping devices can also be inserted into the device over the sheet that is to be folded, and it is also possible tu use sprung, flat frames or leaf springs as clamping devices.

We claim:

1. An apparatus for folding a sheet, in which alternate inward and outward, rectilinear folds extend from the approximate center point of a surface of the sheet, the outward and the inward folds forming opposed pairs in each case, and the outward folds that extend approximately to the corners of the sheet dividing at a distance from the respective corners to outward edge folds that extend substantially parallel to the edges of the sheet that meet at the corners, and an inward corner fold extends from the point of division to the corner, comprising two flat carriers for the sheet, the carriers being foldable one on top of the other about a folding axis lying in their plane; first folding elements pivotal in a plane passing through the folding axis and bisecting the angle between the flat carriers, about the center point of the sheet that is arranged between the flat carriers; second folding elements, each of which has a fold edge passing through the point of division of the outward edge folds and pivotal about the point of division such that it describes a path on the surface of a truncated cone; and clamps for securing the sheet to the carriers.

2. An apparatus according to claim 1, wherein the clamps have flat clamping surfaces and an outer profile that approximates the profile of the sheet when it has been folded together.

3. An apparatus according to claim 1, wherein the clamps can be brought from the edge of the carrier that is opposite the folding axis into a clamping relationship therewith.

4. An apparatus according to claim 1, wherein the clamps are clamping plates that can be swung down onto the carriers about pivot shafts that are adjacent the edges of the carriers opposite the folding axis.

5. An apparatus according to claim 1, wherein the carrier elements have an outline that corresponds to the outline of the sheet that has been folded together and parallel side edges that correspond to the outward edge folds of the sheet to which the second folder elements are articulated.

6. An apparatus according to claim 1, wherein the second folder elements are triangular folding plates that are supported so as to be pivotable on the side edges of the carriers, the fold edges of which extending at approximately 45° to these side edges form the corner inward folds that extend substantially to the corners of the sheet.

7. An apparatus according to claim 1, wherein the carriers are carrier plates that are secured by their edges opposite to the folding axis to pivoting means that can be pivoted about the folding axis and which have recesses with open edges in their edges that face the folding axis, of which the recesses in the one carrier cover off the recesses of the corner carrier plate when in the folded state, and a gripper is provided with gripping elements engaging in the recesses so as to grip the sheet that has been folded together.

8. An apparatus according to claim 1, wherein the edges of the carriers that face the folding axis are set at an angle of 45° to the folding axis and line up with the fold edges of the second folder elements, said second folder elements, folded up, are in the same plane as the associated carriers to which they are articulated.

9. An apparatus according to claim 1, wherein the first folder elements are formed from two folder plates to which are secured first pivoting means that swing in between the carriers, and second pivoting means to swing partly out from the carriers, so as to free the recesses in the carriers after they have been pressed together.

10. An apparatus according to claim 1, comprising pneumatic drive means for the moving parts thereof.

* * * * *